US006074285A

United States Patent [19]

Chiou et al.

[11] Patent Number: 6,074,285

[45] Date of Patent: Jun. 13, 2000

[54] RECIPROCATING FRICTION DRIVE-TYPE ULTRA PRECISION MACHINE

[75] Inventors: Yuang-Cherng Chiou; Rong-Tsong Lee, both of Kaohsiung, Taiwan

[73] Assignee: National Science Council, Taiwan

[21] Appl. No.: 09/130,401

[22] Filed: Aug. 6, 1998

[51] Int. Cl.[7] ..... B24B 7/00

[52] U.S. Cl. ..... 451/273

[58] Field of Search ..... 451/273, 293

[56] References Cited

U.S. PATENT DOCUMENTS

| | | | |
|---|---|---|---|
| 1,035,562 | 8/1912 | Florstedt | 451/114 |
| 1,281,001 | 10/1918 | Hazel | 451/160 |
| 1,317,453 | 9/1919 | Pearson | 451/159 |
| 1,329,551 | 2/1920 | Schulte | 451/213 |
| 1,377,118 | 5/1921 | Eaton | 451/273 |
| 1,608,140 | 11/1926 | Sheehan | 451/45 |
| 2,123,705 | 7/1938 | Ball | 451/273 |
| 2,434,834 | 1/1948 | Civitarese | 451/238 |
| 2,909,006 | 10/1959 | Blood | 451/143 |
| 3,543,450 | 12/1970 | Leibowitz | 451/389 |
| 3,971,170 | 7/1976 | Coburn et al. | 451/42 |
| 4,944,119 | 7/1990 | Gill, Jr. et al. | 451/331 |

FOREIGN PATENT DOCUMENTS

| | | |
|---|---|---|
| 1 251 135 | 12/1960 | France . |
| 831 370 | 2/1952 | Germany . |
| 259651 | 12/1969 | U.S.S.R. . |
| 1395-462 | 5/1988 | U.S.S.R. . |

OTHER PUBLICATIONS

Y. Furukawa et al., *Annals of the CIRP*, vol. 35/1/1986, pp. 279–282.

M. Yamaguchi et al., *J. JSPE*, vol. 56, 1990, pp. 146–151.

M. Takahashi et al., *J. JSPE*, vol. 57, 1991, pp. 102–107.

N. Moronuki, *J. JSPE*, vol. 57, 1991, pp. 20–23.

J. B. Bryan, *Precision Engineering*, pp. 13–17, IPC Business Press.

*Primary Examiner*—Rodney A. Butler

*Attorney, Agent, or Firm*—Skjerven, Morrill, et al.

[57] ABSTRACT

A reciprocating friction-type mirror finishing machine which has a simple construction and performs easily adjustable feeding mode under micrometer scale is disclosed. This machine includes a driving device for generating a driving force in response to a swing motion thereof, and a friction device connected with the driving device for performing alternately clockwise and counterclockwise rotation relative to a work stand in contact therewith to generate a linearly reciprocating frictional force in response to the driving force. The frictional force allows a work piece held by the work stand to be fed in a linearly reciprocating motion to be ground.

11 Claims, 3 Drawing Sheets

RECIPROCATING FRICTION DRIVE-TYPE ULTRA PRECISION MACHINE

FIELD OF THE INVENTION

The present invention is related to a friction drive-type ultra precision machine, particularly to a reciprocating friction drive-type ultra precision machine, and more particularly to a reciprocating friction drive-type mirror finishing machine.

BACKGROUND OF THE INVENTION

A conventional mirror finishing machine is a super-finishing machine which employs a crank-slider mechanism as a motion mechanism. The motion mechanism of the super-finishing machine is schematically shown in FIG. 1, and includes a spring 10, an abrasive stone 12, an eccentric rod 13, a connecting rod 14, and a slider 15. The eccentric rod 13 is engaged with the connecting rod 14 which is further connected to the slider 15. The abrasive stone 12 is mounted on the slider 15, and sustains against a work piece (not shown) owing to the elastic force of the spring 10. During the operation, a motor (not shown) drives the eccentric rod 13 of a certain eccentricity (e), as indicated by a circular track arrow, so as to further transmit the slider 15 through the connecting rod 14 to have a reciprocating motion. Accordingly, the abrasive stone 12 mounted on the slider 15 synchronously reciprocates and grinds the surface of the work piece to a mirror level, i.e. a roughness of 0.1~0.5 $\mu$m maximal height.

For the conventional super-finishing machine, the stroke of the reciprocation of the slider, and the abrasive stone, is generally equal to the revolving diameter of the crank, i.e. 2*e*, which is as small as a couple of millimeters. Furthermore, the reciprocating motion is confined to a small specific area. Consequently, the super-finishing machine has to be mounted on an work stand of another machine so that the abrasive stone can travel farther by way of a screw rod of the additional work stand.

Several further designs for micron-level feeding and precise positioning have been developed. For example, Y. Furukawa et al. designed a micro cutting machine which performs micron-level feeding by way of friction drive (*Annals of the CIRP*, Vol. 35/1/1986, p. 279–282); M. Yamaguchi et al. developed a precise feed mechanism combining friction drive with an air slider and applied to an ultra precision lathe (*J. JSPE*, Vol. 56, 1990, p. 146–151); and M. Takahashi et al. developed an experimental apparatus which performs precise positioning by way of friction drive (*J. JSPE*, Vol. 57, 1991, p. 102–107). In addition, various ultra precision machines have been developed, and even marketed, by Lawrence Livermore Laboratory (U.S.A.) and Euro Precision Technology company (Japan).

The friction drive for the feeding and/or positioning mechanism of the aforementioned designs, however, is driven by a servo motor in a single direction so as not to be very suitable for a mirror finishing machine.

SUMMARY OF THE INVENTION

An object of the present invention is to provide a friction-drive type mirror finishing machine, which combines the properties of tiny reciprocating-stroke motion and automatic micron-level feeding so as to comply with the requirement on ultra precision.

The present invention is related to a friction-type mirror finishing machine for grinding a surface of a work piece to a mirror level. The friction-type mirror finishing machine includes a grinding device for grinding the work piece; an work stand for supporting the work piece, and cooperating with the grinding device to grind the work piece; a driving device for generating a driving force in response to a swing motion thereof; and a friction device connected with the driving device, and being in contact with the work stand for performing alternately clockwise and counterclockwise rotation relative to the work stand to generate a linearly reciprocating frictional force in response to the driving force. The frictional force allows the work piece to be fed in a linearly reciprocating motion to be ground.

In an embodiment, the grinding device includes a motor; and an abrasive stone, connected to and driven by the motor to perform a grinding operation.

The work stand may includes a linear guide rail, and a carrier for loading the work piece. The carrier linearly reciprocates along the guide rail to feed the work piece. In a preferred embodiment, the carrier has a guide roller in contact with the guide rail, and the rolling of the guide roller against the guide rail transmits the carrier to move along the guide rail. More preferably, the work stand further includes a spring element located between the work piece and the carrier for making the work piece in close contact with the abrasive stone so as to facilitate the grinding operation.

Preferably, the driving device includes a crank; and a rocker connected with the crank through a connecting rod, and performing a swing motion in response to a rotation motion of the crank to generate the driving force.

On the other hand, the friction device may include a driver ring engaged with the carrier of the work stand preferably through a follower and a spring. The driver ring is connected with and coaxial to the rocker, and rotates alternately clockwise and counterclockwise to generate the linearly reciprocating frictional force in response to the driving force. The spring is located between the follower and the carrier for making the follower in close contact with the driver ring so as to facilitation the generation of the frictional force.

BRIEF DESCRIPTION OF THE DRAWING

The present invention may best be understood through the following description with reference to the accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
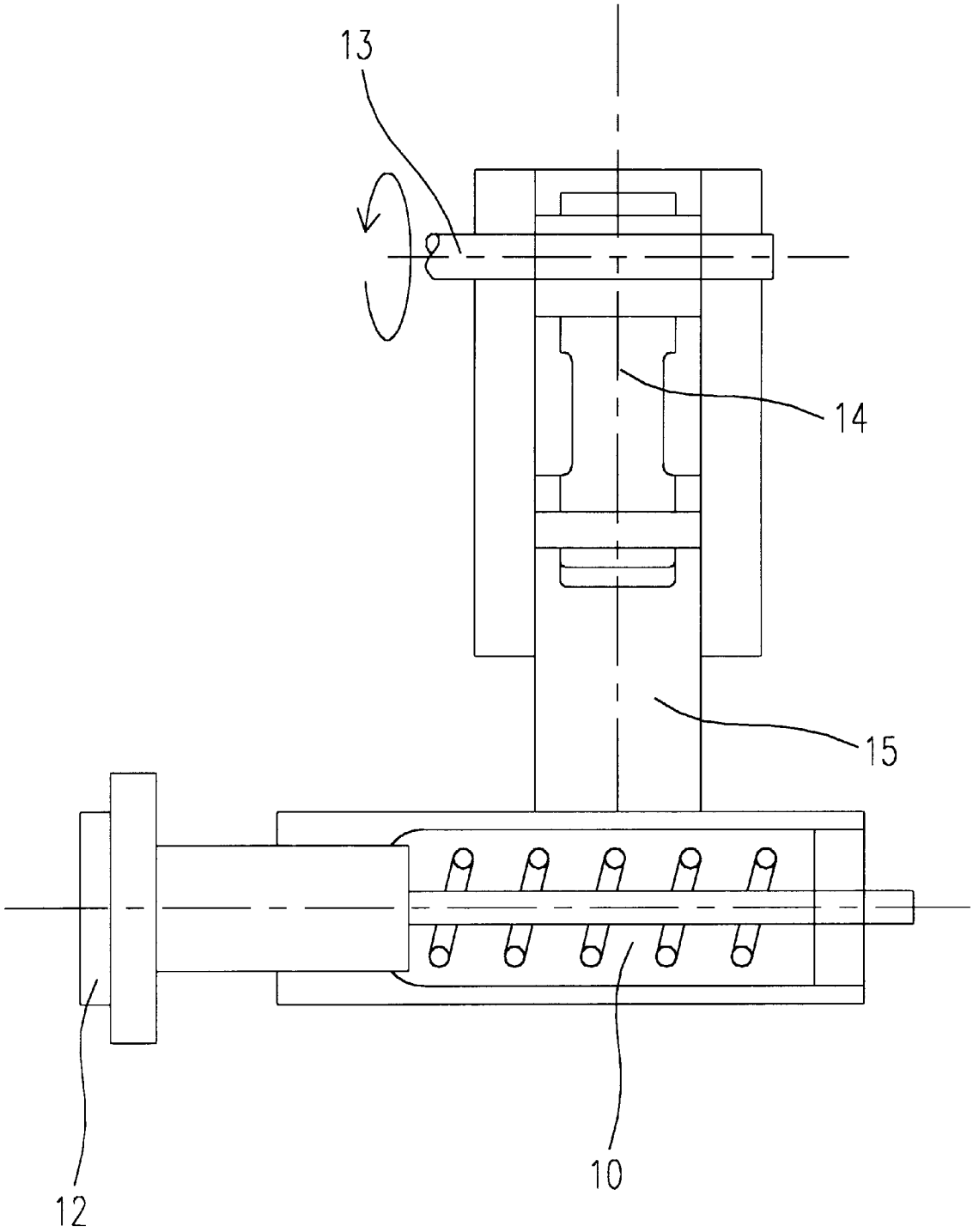
FIG. 1 is a schematic diagram showing a conventional super-finishing machine.
Figure 2:
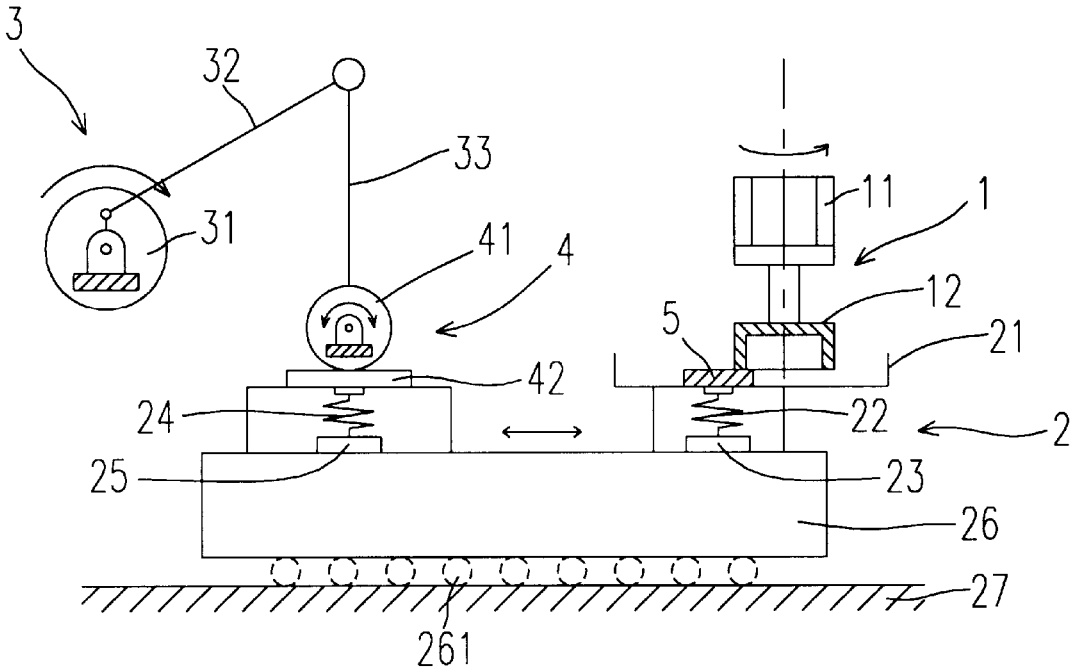
FIG. 2 is a schematic diagram showing a preferred embodiment of a reciprocating friction-type mirror finishing machine according to the present invention.

Please refer to FIG. 2 which schematically shows a preferred embodiment of a reciprocating friction-type mirror finishing machine according to the present invention. The mirror finishing machine shown in FIG. 2 includes a grinding device 1, a work stand 2, a driving device 3 and a friction device 4. The grinding device I includes a motor 11 and a abrasive stone 12. The abrasive stone 12 is driven by the motor 11 to grind a work piece 5 supported on a plate 21 of the work stand 2. Below the plate 21, a spring 22 is used to make the work piece 5 in close contact with the abrasive stone 12. Optionally but preferably, a load cell 23 is mounted under the spring to monitor the grinding status of the work piece 5. On the other hand, the driving device 3 is a crank-rocker mechanism including a crank 31, a connecting rod 32 and a rocker 33, and the friction device 4 includes a driver ring 41 and a follower 42. The rotation of the crank 31 transmits the rocker 33 to swing through the connecting rod 32. The swing motion of the rocker 33 transmits the driver ring 41 coaxial thereto to alternately rotate clockwise and counterclockwise so that the follower 42 in frictional contact with the driver ring 41 reciprocates by way of the frictional force between the driver ring 41 and the follower 42. Below the follower 42, another spring 24 is used to make the follower 42 in close contact with the driver ring 41. Optionally but preferably, a load cell 25 is mounted under the spring to monitor the contact status and control the frictional force between the driver ring 41 and the follower 42.

The follower 42, the spring 24 and the load cell 25 of the friction-force generation portion, and the work piece 5, the plate 21, the spring 22 and the load cell 23 of the grinding operation portion are both attached to a carrier 26 of the work stand 2. The carrier 26 has guide rollers 261 engaged with a linear guide rail 27 of the work stand 2. When the frictional force enables the follower 42 to have a reciprocating motion, the carrier 26 thereunder will synchronously reciprocate along the guide rail 27 by means of the rolling of the guide roller 261 against the guide rail 27. The reciprocation of the carrier 26 further transmits the work piece 5 to synchronously reciprocate relative to the abrasive stone 12, thereby allowing the abrasive stone 12 to grind the work piece 5.

It should be noted that according to the present invention, the feeding of the work piece can achieve a millimeter, a micron or even a sub-micron level, which is controlled by a slight speed difference between the clockwise and the counterclockwise rotation of the driver ring. By changing the length of the crank or the eccentricity, the reciprocating stroke of the follower, and simultaneously the carrier and the work piece, can be adjusted. Furthermore, the swing mode of the rocker will also be changed accordingly so as to cause different speed difference between the clockwise and the counterclockwise rotation of the driver ring.

Figure 3:
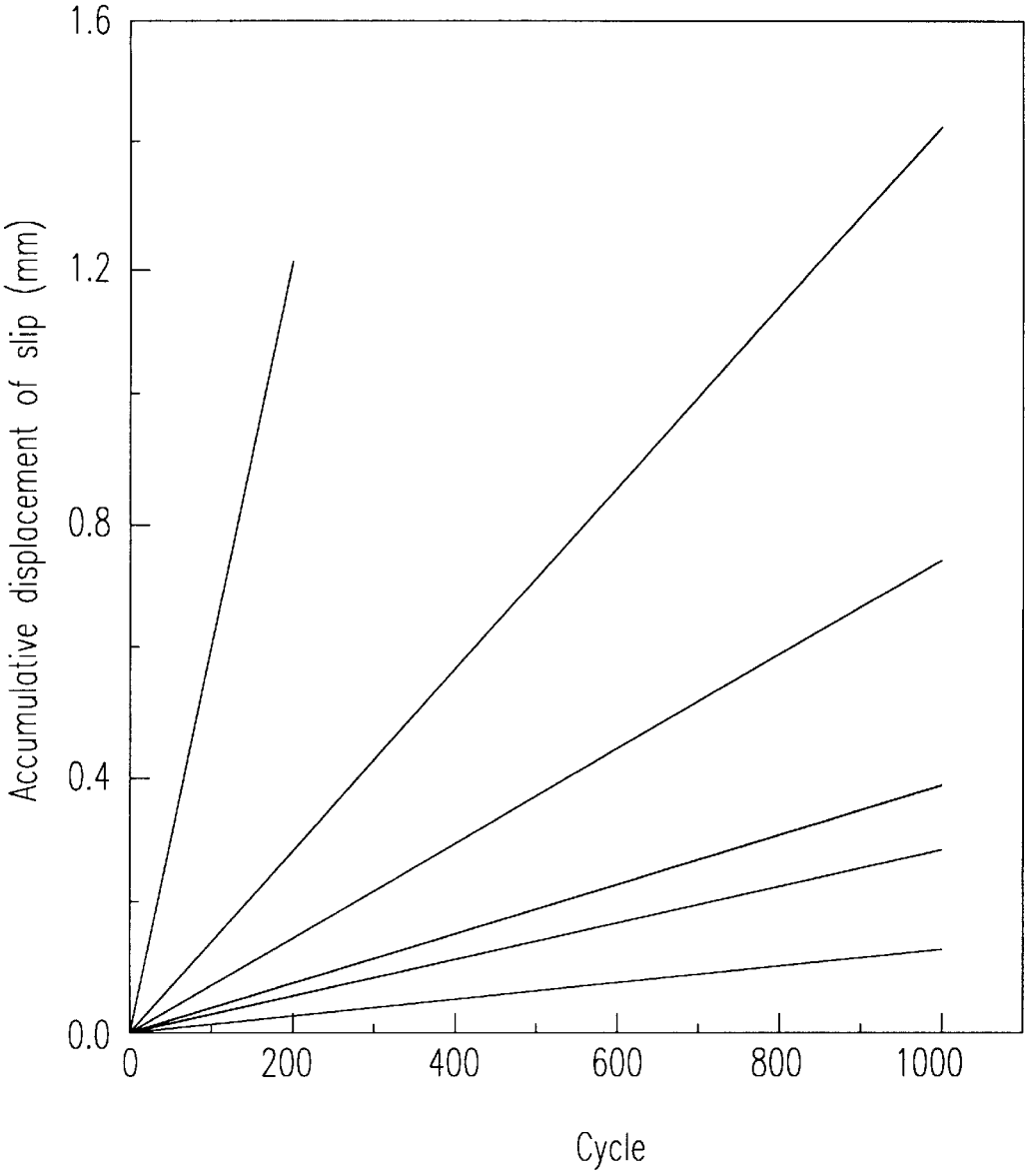
FIG. 3 is a displacement vs. cycle plot showing the relationship between the accumulative displacement of slip and the rotating cycles of the crank in the mirror finishing machine of FIG. 2.

Please refer to FIG. 3 which is a plot of an accumulative displacement of slip vs. rotating cycle of the crank 31 of the mirror finishing machine of FIG. 2 on the conditions that the driving stroke is set to be 2.058 mm, the driving speed is set to be 200 cpm, and the normal load is controlled to be 10, 20, 30, 40, 50 and 55 N. respectively for lines 1~6. In order to measure the displacement, a displacement transducer (not shown) is mounted on the carrier 26 or the follower 42. As shown in FIG. 3, the accumulative displacement of slip is substantially linearly proportional to the rotating cycles. A micron or even a sub-micron level feeding per cycle can be achieved at higher normal load measured by the load cell 25. Hence, these results show that micro-level feeding can be performed by means of friction drive according to the present invention without any auxiliary feeding mechanism.

In the preferred embodiment, the crank-rocker mechanism is employed to generate the reciprocating motion in the friction drive system, where the driver ring has the same input-output relation as the rocker, and it is used to drive the follower, the carrier, and the work piece. For the purpose of mirror finishing, the linearly reciprocating motion is preferably in a micron or a millimeter scale. On the other hand, by controlling the speed difference between the clockwise and the counterclockwise motion of the driver ring. According to the present design, it is easy to generate a micro-slip displacement between the driver ring and the carrier. This micro-slip displacement can achieve the automatically feeding function in a micron level without any auxiliary feeding mechanism. Moreover, the combination of the small-stroke reciprocating motion and the micron-level feeding operation make the mirror finishing machine simple in structure with a satisfactory mirror finishing effect.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A friction-type mirror finishing machine for grinding a surface of a work piece to a mirror level, comprising:

a grinding device for grinding said work piece;

a work stand for supporting said work piece, and cooperating with said grinding device to grind said work piece;

a driving device for generating a driving force in response to a swing motion thereof; and a friction device connected with said driving device, said friction device comprising a driver ring supported by said work stand for asymmetrically rotating in a clockwise and counterclockwise direction in response to said driving force, wherein the asymmetrical rotation of said driver ring moves said work stand in a linearly reciprocating manner with a micro-level shift per reciprocating cycle to allow said work piece supported by said work stand to be fed across said grinding device.

2. The friction-type mirror finishing machine according to claim 1 wherein said grinding device includes:

a motor; and an abrasive stone connected to and driven by said motor to perform a grinding operation.

3. The friction-type mirror finishing machine according to claim 1 wherein said work stand includes:

a linear guide rail; and a carrier for loading said work piece, said carrier linearly reciprocating along said linear guide rail to feed said work piece.

4. The friction-type mirror finishing machine according to claim 1 wherein said driving device includes:

a crank; and a rocker connected with said crank through a connecting rod, and performing a swing motion in response to a rotation motion of said crank to generate said driving force.

5. The friction-type mirror finishing machine according to claim 3 wherein said work stand further includes a first spring element located between said work piece and said carrier for making said work piece in close contact with said abrasive stone so as to facilitate the grinding operation.

6. The friction-type mirror finishing machine according to claim 3 wherein said carrier has a guide roller in contact with said linear guide rail, and the rolling of said guide roller against said linear guide rail transmits said carrier to move along said linear guide rail.

7. The friction-type mirror finishing machine according to claim 3 wherein said friction device includes:

a follower located between said carrier and said driver ring to generate a linearly reciprocally frictional force in response to the clockwise and counterclockwise rotation of said driver ring to transmit said carrier.

8. The friction-type mirror finishing machine according to claim 7 wherein said work stand further includes a second spring element located between said follower and said carrier for making said follower in close contact with said driver ring so as to facilitation the generation of said frictional force.

9. A device for removing a portion of a surface of a work piece comprising:

a grinding assembly having an abrasive element, said abrasive element grinding against a surface of a work piece;

a work stand supporting said work piece, said work stand is configured to move said work piece in a linear direction;

a driver ring used for rotating asymmetrically in a clockwise and counterwise direction to move said work stand in said linear direction; and a driving assembly used for rotating said driver ring in said clockwise and counterclockwise direction.

10. The device of claim 9, additionally comprising a spring element for compressing said work piece against said abrasive element.

11. The device of claim 9, additionally comprising:

a follower supported by said work stand and in compressive engagement with said driver ring; and a spring assembly for compressing said follower against said driver ring.

* * * * *